US005564490A

United States Patent [19]

Liebermann et al.

[11] Patent Number: 5,564,490

[45] Date of Patent: Oct. 15, 1996

[54] HOMOGENEOUS QUENCH SUBSTRATE

[75] Inventors: Howard H. Liebermann, Succasunna, N.J.; David F. Teller, Murrells Inlet, S.C.

[73] Assignee: AlliedSignal Inc., Morris Township, N.J.

[21] Appl. No.: 428,805

[22] Filed: Apr. 24, 1995

[51] Int. Cl.[6] ..... B22D 11/06

[52] U.S. Cl. ..... 164/463; 164/423; 164/429

[58] Field of Search ..... 164/423, 463, 164/429, 479, 428, 480

[56] References Cited

U.S. PATENT DOCUMENTS 4,190,095 2/1980 Bedell ..... 164/423
4,202,404 5/1980 Carlson ..... 164/423
4,307,771 12/1981 Draizen et al. ..... 164/479
4,475,583 10/1984 Ames ..... 164/429
4,479,528 10/1984 Maringer ..... 164/429

FOREIGN PATENT DOCUMENTS 477121 9/1990 European Pat. Off. .

*Primary Examiner*—Jack W. Lavinder
*Assistant Examiner*—Randolph Herrick
*Attorney, Agent, or Firm*—Ernest D. Buff

[57] ABSTRACT

A quench substrate for rapid solidification of molten alloy into strip has a microcrystalline or amorphous structure. The substrate is composed of a thermally conducting alloy and the structure is substantially homogeneous. The substrate is a thermal conducting material such as copper or a copper alloy, and has a constituent grain size uniformity greater than 1 μm and less than 1,000 μm in size.

7 Claims, 4 Drawing Sheets

1,000 μm

HOMOGENEOUS QUENCH SUBSTRATE

BACKGROUND OF THE INVENTION

1. Field Of The Invention

This invention relates to an apparatus and method for rapid quenching of molten alloy. More particularly, it relates to characteristics of the quenching surface of a casting wheel used in the continuous casting of metallic strip.

2. Description Of The Prior Art

Continuous casting of alloy strip is accomplished by depositing molten alloy onto a rotating casting wheel. Strip forms as the molten alloy stream is attenuated and solidified by the wheel's moving quench surface. For continuous casting, this quenching surface needs to withstand mechanical damage arising from cyclical stressing due to thermal cycling during casting. Means by which improved performance of the quench surface can be achieved include the use of alloys having high thermal conductivity and high mechanical strength. Examples include copper alloys of various kinds, steels and the like. Alternatively, various surfaces can be plated onto the casting wheel quench, surface in order to improve its performance, as disclosed in European Patent No. EP0024506. Details of a suitable casting procedure have been disclosed in U.S. Pat. No. 4,142,571, and the disclosure of that patent is incorporated herein by reference.

Casting wheel quench surfaces of the prior art generally have been of two forms: monolithic or component. In the former, either a solid block of alloy is fashioned into the form of a casting wheel—either with or without cooling channels incorporated therein. The latter consists of two or more pieces which, when assembled, constitute a casting wheel, as disclosed in U.S. Pat. No. 4,537,239. The casting wheel quench surface improvements of the present disclosure are applicable to all kinds of casting wheels.

Casting wheel quench surfaces of the prior art generally have been made from alloy which was cast and mechanically worked in some manner prior to fabricating a wheel/quench surface therefrom. Certain mechanical properties such as hardness, tensile and yield strength, and elongation had been considered, sometimes in combination with thermal conductivity. This was done in an effort to achieve the best combination of mechanical strength and thermal conductivity properties possible for a given alloy. The reason for this is basically twofold: 1) to provide a quench rate which is high enough to result in the cast strip microstructure which is desired, 2) to resist quench surface mechanical damage which would result in degradation of strip geometric definition and thereby render the cast product unserviceable.

An alloy strip casting process is complicated and dynamic or cyclical mechanical properties need to be seriously considered in order to develop a quench surface which has superior performance characteristics. The processes by which the feedstock alloy for use as a quenching surface is made can significantly affect subsequent strip casting performance. This can be due to the amount of mechanical work and subsequent strengthening phases which occur after heat treatment. It can also be due to the directionality or the discrete nature of some mechanical working processes. For example, ring forging and extrusion both impart anisotropy of mechanical properties to a work piece. Unfortunately, the direction of this resulting orientation is not typically aligned along the most useful direction within the quench surface. The heat treatment to achieve alloy recrystallization and grain growth and strengthening phase precipitation with the alloy matrix is often insufficient to ameliorate the deficiencies induced during the mechanical working process steps. The results are a quench surface with microstructure having non-uniform grain size, shape, and distribution.

A consequence of having a quench surface grain structure such as the one described is a predisposition of that component to fail prematurely while in the service of continuously casting alloy strip. As mentioned, the ab initio grain size non-uniformity will result in greatly limited fatigue life of any component for which it is used.

SUMMARY OF THE INVENTION

The present invention provides an apparatus for continuous casting of alloy strip. Generally stated, the apparatus has a casting wheel providing a quench substrate for cooling of a molten alloy layer deposited thereon during the rapid solidification of a continuous alloy strip. The quench substrate has a crystalline or amorphous structure. It is composed of a thermally conducting alloy and has a grain size that is substantially homogeneous.

The casting wheel of the present invention optionally has a cooling means for maintaining said quench surface at a fixed temperature as it enters beneath the alloy being deposited thereon and quenched. A nozzle is mounted in spaced relationship to the quench substrate for expelling molten alloy therefrom. The molten alloy is directed by the nozzle to a region of the quench substrate, whereon it is deposited. A reservoir is in communication with said nozzle for holding molten alloy and feeding it to the nozzle.

Preferably, the quench substrate has a constituent grain size uniformity characterized by about 80% of the grains having a size greater than 1 μm and less than 50 μm, and the balance having greater than 50 μm and less than 300 μm.

Use of a quench substrate having a crystalline or amorphous structure which is thermally conducting and substantially homogeneous advantageously increases the service life of the quench substrate. Yields of ribbon rapidly solidified on the substrate are markedly improved. Down time involved in maintainance of the substrate is minimized and the reliability of the process is increased.

BRIEF DESCRIPTION OF THE DRAWINGS

The invention will be more fully understood and further advantages will become apparent when reference is had to the following detailed description and the accompanying drawings, in which.

DETAILED DESCRIPTION OF THE INVENTION

Figure 1:
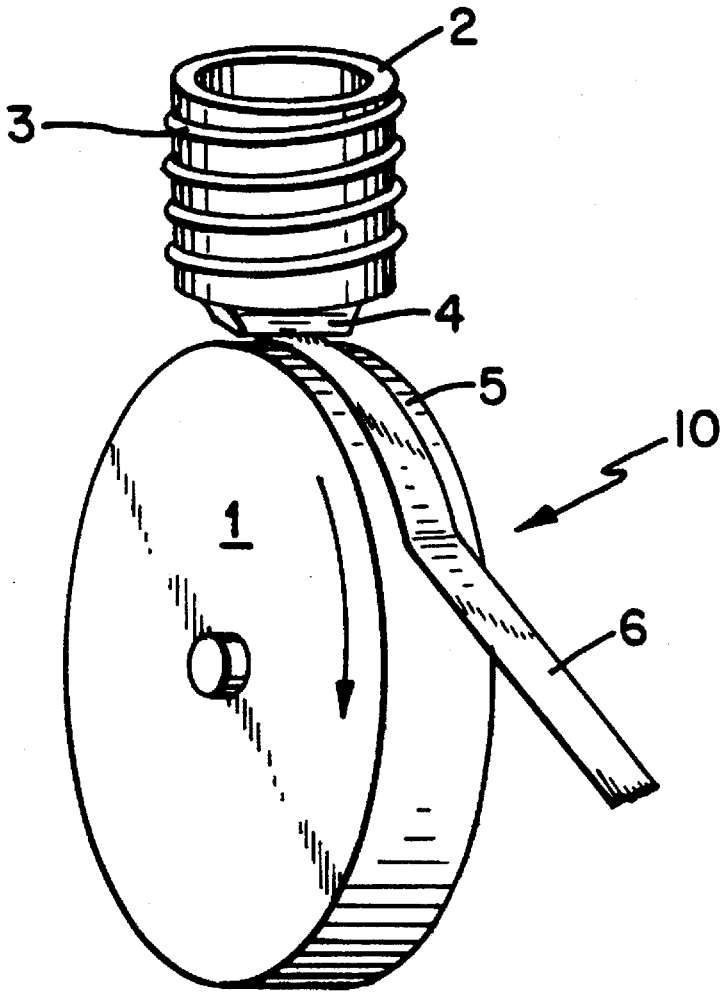
FIG. 1 is a perspective view of an apparatus for continuous casting of metallic strip.

As used herein, term "amorphous metallic alloys" means a metallic alloy that substantially lacks any long range order and is characterized by X-ray diffraction intensity maxima which are qualitatively similar to those observed for liquids or inorganic oxide glasses.

The term microcrystalline alloy, as used herein, means an alloy that has a grain size less than 10 μm (0.004 in.). Preferably such an alloy has a grain size ranging from about 100 nm (0.000004 in.) to 10 μm (0.004 in.), and most preferably from about 1 μm (0.00004 in.) to 5 μm (0.0002 in.).

As used herein, the term "strip" means a slender body, the transverse dimensions of which are much smaller than its length. Strip thus includes wire, ribbon, and sheet, all of regular or irregular cross-section.

The term "rapid solidification", as used herein throughout the specification and claims, refers to cooling of a melt at a rate of at least about $10^4$ to $10^6$ °C./s. A variety of rapid solidification techniques are available for fabricating strip within the scope of the present invention such as, for example, spray depositing onto a chilled substrate, jet casting, planar flow casting, etc.

As used herein, the term "wheel" means a body having a substantially circular cross section having a width (in the axial direction) which is smaller than its diameter. In contrast, a roller is generally understood to have a greater width than diameter.

By substantially homogeneous is herein meant that the quench surface is of substantially uniform grain size in all directions. Preferably, a quench substrate that is substantially homogeneous has a constituent grain size uniformity characterized by about 80% of the grains having a size greater than 1 μm and less than 50 μm and the balance being greater than 50 μm and less than 300 μm.

The term "thermally conducting", as used herein, means that the quench substrate has a thermal conductivity value greater than 40 W/m K and less than about 400 W/m K, and more preferably greater than 60 W/m K and less than about 400 W/m K, and most preferably greater than 80 W/m K and less than 400 W/m K.

In this specification and in the appended claims, the apparatus is described with reference to the section of a casting wheel which is located at the wheel's periphery and serves as a quench substrate. It will be appreciated that the principles of the invention are applicable, as well, to quench substrate configurations such as a belt, having shape and structure different from those of a wheel, or to casting wheel configurations in which the section that serves as a quench substrate is located on the face of the wheel or another portion of the wheel other than the wheel's periphery.

The present invention provides an apparatus and method for use of a quench substrate in the rapid quenching of molten metal. In a preferred embodiment of the apparatus, the ratio of the diameter of the casting wheel to the maximum width of the casting wheel measured in the axial direction is at least about one. Rapid and uniform quenching of metallic strip is accomplished by providing a flow of coolant fluid through axial conduits lying near the quench substrate. Also, large thermal cycling stresses result because of the periodic deposition of molten alloy onto the quenching substrate as the wheel rotates during casting. This results in a large radial thermal gradient near the substrate surface. To prevent the mechanical degradation of the quench substrate which would otherwise result from this large thermal gradient and thermal fatigue cycling, the substrate is comprised of fine, uniform-sized constituent grains. Cooling fluid may be conveyed to and from the casting wheel through two spaced-apart axial cavities in the shaft. Fluid inlets and outlets provide fluid communication between the cavities and two chambers in the wheel. The chambers are separated by a wall extending from the shaft to the chill surface.

The apparatus and method of this invention are suitable for forming polycrystalline strip of aluminum, tin, copper, iron, steel, stainless steel and the like. Metallic alloys that, upon rapid cooling from the melt, form solid amorphous structures are preferred. These are well known to those skilled in the art. Examples of such alloys are disclosed in U.S. Pat. Nos. 3,427,154 and 3,981,722.

Referring to FIG. 1, there is shown generally at 10, an apparatus for continuous casting of metallic strip. Apparatus 10 has an annular casting wheel 1 rotatably mounted on its longitudinal axis, reservoir 2 for holding molten metal and induction heating coils 3. Reservoir 2 is in communication with slotted nozzle 4, which is mounted in proximity to the substrate 5 of annular casting wheel 1. Reservoir 2 is further equipped with means (not shown) for pressurizing the molten metal contained therein to effect expulsion thereof though nozzle 4. In operation, molten metal maintained under pressure in reservoir 2 is ejected through nozzle 4 onto the rapidly moving casting wheel substrate 5, whereon it solidifies to form strip 6. After solidification, strip 6 separates from the casting wheel and is flung away therefrom to be collected by a winder or other suitable collection device (not shown).

The material of which the the casting wheel quench substrate 5 is comprised may be copper or any other metal or alloy having relatively high thermal conductivity. This requirement is particularly applicable if it is desired to make amorphous or metastable strip. Preferred materials of construction for substrate 5 include fine, uniform grain-sized precipitation hardening copper alloys, such as chromium copper or beryllium copper, dispersion hardening alloys, and oxygen-free copper. If desired, the substrate 5 may be highly polished or chrome-plated or the like to obtain strip having smooth surface characteristics. To provide additional protection against erosion, corrosion or thermal fatigue, the surface of the casting wheel may be coated in the conventional way using a suitable resistant or high-melting coating. Typically, a ceramic coating or a coating of corrosion-resistant, high-melting temperature metal is applicable, provided that the wettability of the molten metal or alloy being cast on the chill surface is adequate.

As mentioned hereinabove, it is important that the grain size and distribution of the quench surface upon which molten metal or alloy is continuously cast into strip be both fine and uniform, respectively. A comparison of two different quench surface manufacturing methods with respect to strip casting performance is presented in FIG. 2. In the method which typically results in quench surface microstructure outside the scope of the invention, ring forging is used in the thermo-mechanical processing of the quench surface. This metal working method imparts discrete hammer blows to an annular quench surface to prepare it for subsequent heat treatment in order to develop high strength. The limitation of this kind of mechanical working method is largely its discrete, incremental nature. That is, not all volume elements of the quench surface are equally worked and subsequent bimodal grain size distributions can occur, with the sporadic occurrence of some large grains likely in a matrix of fine grains. This kind of bimodal grain size distribution has been found to be deletrious to quench surface performance in the continuous casting of metal or alloy strip. A specific manner in which quench substrate degradation occurs under such circumstances is through the formation of very small cracks in the surface thereof. Subsequently desposited molten metal or alloy then enters these small cracks, solidifies therein, and gets pulled out, together with adjacent quench substrate materials, as the cast strip is separated from the quench substrate during operation. The degradation process is degenerative, growing progessively worse with time into a cast. Cracked or pulled out spots on the quench substrate are called "pits", while the associated replicated protrusions attached to the underside of the cast strip are called "pips."

The quench substrate of the present invention is made by melting the requisite components of the quench substrate alloy and pouring the melt into a mold, thereby forming an ingot. This as-cast ingot is impact-hammered repeatedly (forged) to disrupt the cast-in grain structure of the ingot and thereby form a billet. The billet is subjected to piercing by a mandrel to result in a cylindrical body for further processing. The cylindrical body is cut into cylindrical lengths, which more nearly approach the shape of the final quench surface. In order to promote the nucleation and growth (recrystallization) of fine grains, the cylindrical lengths are subjected to a number of mechanical deformation processes. These processes include: (1) ring forging, in which the cylindrical length is supported by an anvil (saddle) and repeatedly pounded by a hammer, as the cylindrical length is gradually rotated about the anvil, thereby treating the entire circumference of the cylindrical length by discrete impact blows; (2) ring rolling, which is similar to ring forging, except that mechanical working of the cylindrical length is achieved in a much more uniform manner by the use of a set of rollers, rather than by a hammer; and (3) flow forming, in which a mandrel is used to define the inside diameter of the quench surface and a set of working tools act circumferentially around the cylindrical length while simultaneouly being translated along the cylindrical length, thereby simultaneously thinning and elongating the cylindrical length while imparting extensive mechanical deformation.

In addition to the mechanical deformation processes described above, various heat treatment steps, carried out either between or during the mechanical deformation, may be utilized to facilitate processing and/or to recrystallize quench surface grains, and to produce the hardening phases in the quench surface alloy.

Figure 2A:
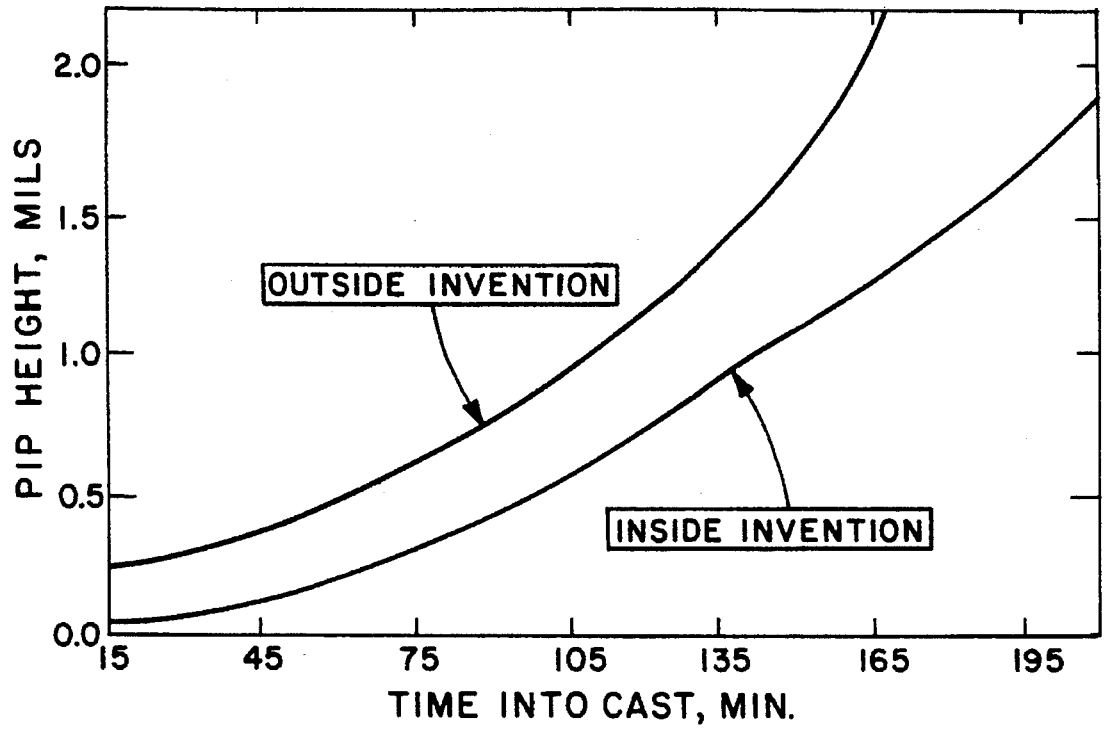
FIG. 2*a* is a graph showing quench substrate performance degradation ("pipping") with time into continuous casts for a 6.7 inch wide amorphous alloy strip.
Figure 2B:
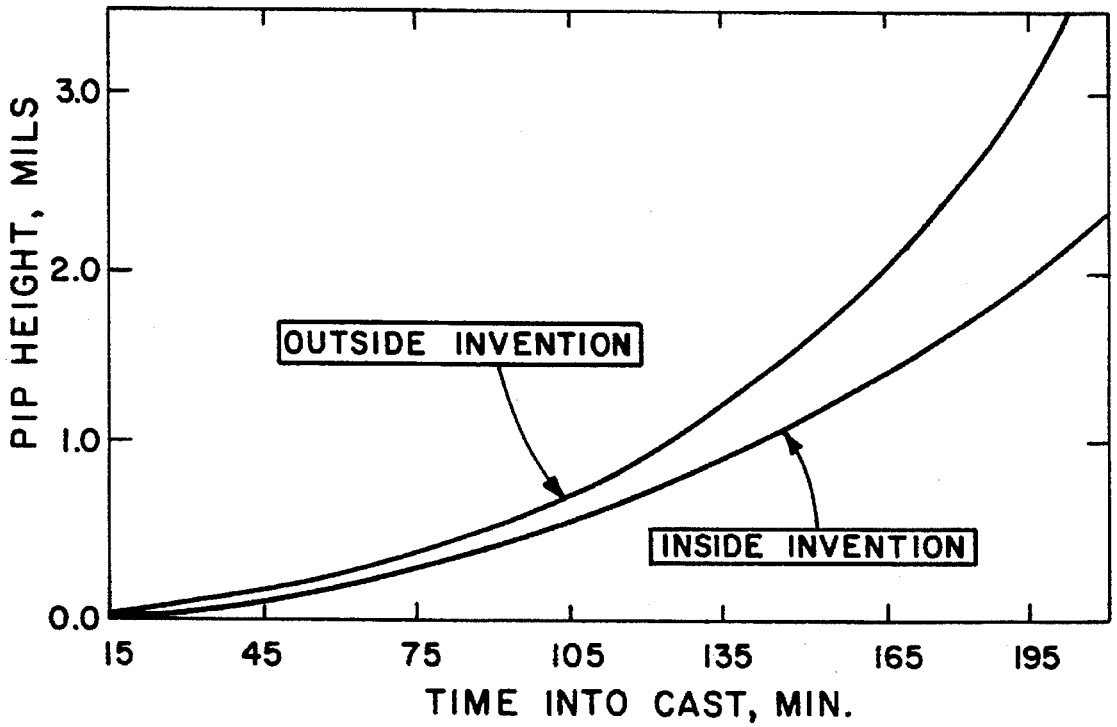
FIG. 2*b* is a graph showning quench substrate performance degradation with time into continuous cast for an 8.4 inch wide amorphous alloy strip.

An example of a mechanical working process which would likely result in the quench surface microstructure includes ring rolling, in which an annular quench surface is subjected to continuous mechanical deformation throughout every element of volume. Another example of such a mechanical working process is that of flow-forming, in which metal is uniformly deformed to very large extents. These kinds of continuous deformation processes advantageously produce in the quench substrate a very fine, uniform grain size which is within the scope of the invention. The data in FIG. 2 show the improved resistance to pitting exhibited by a quench substrate that is subjected to thermomechanical working, such as ring rolling or extrusion, prior to heat treatment to develop final properties.

Figure 3A:
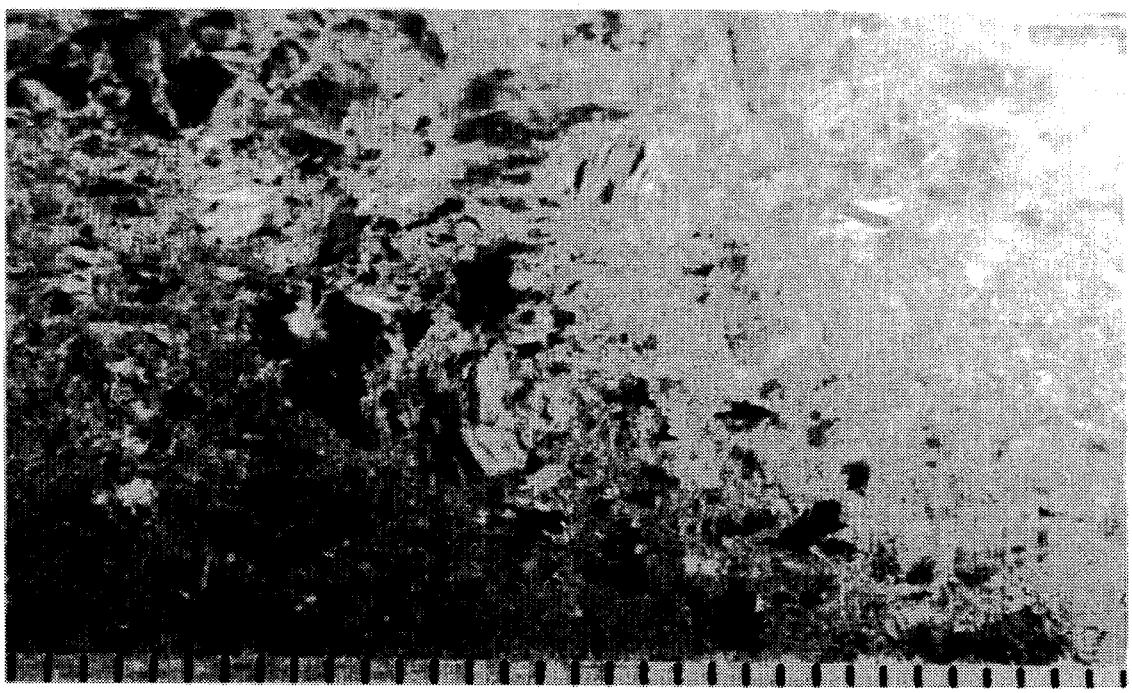
Fig. 3a (PRIOR ART)
FIG. 3*a* is a photomicrograph of a prior art quench substrate, showing typical grain size and distribution thereof.
Figure 3B:
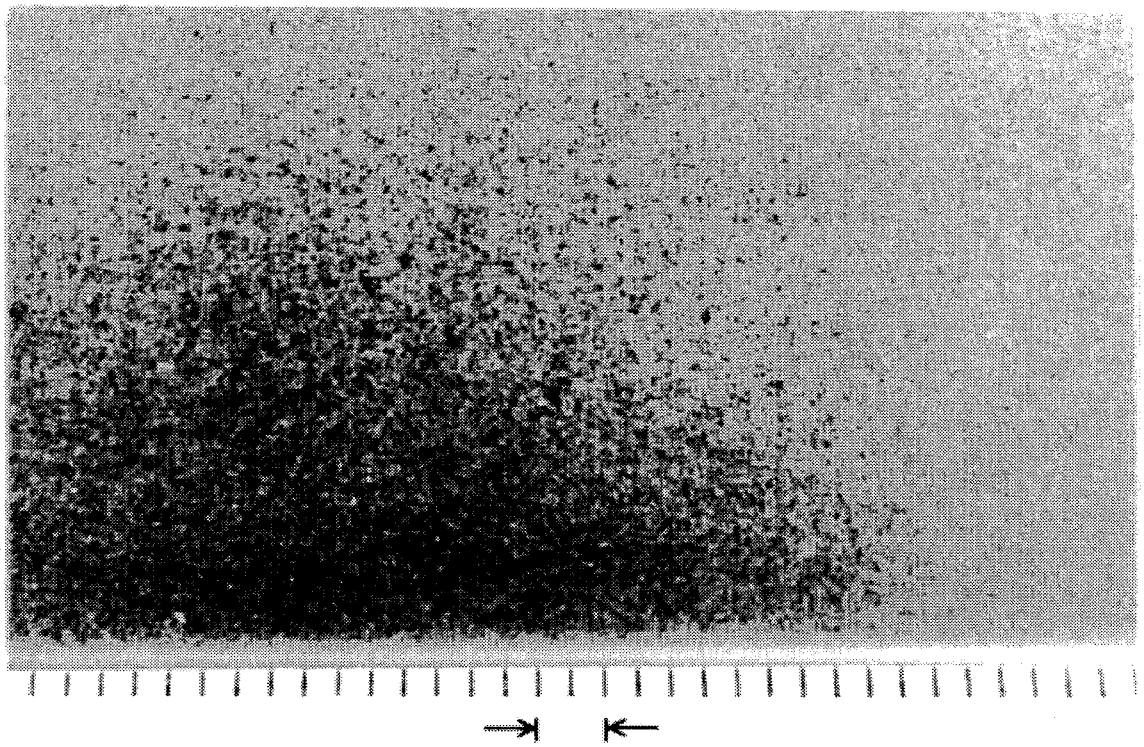
FIG. 3*b* is a photomicrograph of a quench substrate of the present invention, showing typical grain size and distribution thereof.

Comparative microstructures of quench surfaces within and outside the scope of the present invention are shown in FIGS. 3*a* and 3*b*. The quench surface of the prior art (FIG. 3*a*) shows about 50% of the grains having an average size of about 1,500 μm, while the remaining 50% has a grain size of less than 50 μm. The quench surface of the present invention (FIG. 3*b*) has about 100% of the grains with an average grain size of less than 50 μm. A very fine, uniform grain size and distribution is shown for the quench surface of the invention.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

Beryllium copper alloy 25 quench surface components mounted on a cooled wheel assemblies were used to produce 6.7 inch and 8.4 inch wide iron-based amorphous alloy in a series of more than eight hundred iron-based amorphous alloy ribbon casts using a quench substrate outside the scope of this invention, and more than seventy iron-based amorphous alloy casts using a quench substrate inside the scope of this invention. Two different quench substrate grain size distributions were associated with the manufacturing process by which they were made. One quench substrate manufacturing process produced a constituent grain size and distribution that was substantially uniform and homogeneous, the other did not. The mechanical degradation of the quench surface, and subsequent loss of cast strip product quality, is manifested in the form of surface cracks and pits resulting from the severe thermal cycling to which the quench surface is subjected during strip casting. A replication of these quench surface defects occurs continuously during strip casting. Thus, quench surface mechanical degradation with time is indicated by the size of "pips" in the cast ribbon underside. Pips are tiny protrusions in the strip underside which result from the replication of cracks and pits in the quench surface. The data curves in FIG. 2 show how the size of pips on the underside of cast strip increase with time into a cast for both quench surface manufacturing methods and for both cast strip widths. Photomicrographs of the quench surfaces within the scope and outside the scope of the present invention are shown in FIGS. 3*a* and 3*b*.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A quench substrate for rapid solidification of molten alloy into strip having a microcrystalline or amorphous structure, said quench substrate comprising a thermally conducting alloy having a constituent grain size uniformity greater than 1 μm and less than 1,000 μm in size and said structure being of substantially uniform grain size in all directions.

2. A quench substrate as recited in claim 1, wherein the constituent grain size uniformity is typically greater than 1 μm and less than 300 μm in size.

3. A quench substrate as recited in claim 1, wherein said alloy has a constituent grain size uniformity characterized by about 80% of said grains having a size greater than 1 μm and less than 50 μm and the balance being greater than 50 μm and less than 300 μm.

4. A quench substrate as recited in claim 1, wherein said thermally conducting alloy is copper-based.

5. A quench substrate as recited in claim 4, wherein said thermally conducting alloy is a dispersion-hardened copper alloy.

6. A quench substrate as recited in claim 4, wherein said thermally conducting alloy is a precipitation-hardened copper alloy.

7. A quench substrate as recited in claim 6, wherein said thermally conducting alloy is a beryllium copper alloy.

* * * * *